US009349357B2

(12) United States Patent
Iyer

(10) Patent No.: US 9,349,357 B2
(45) Date of Patent: May 24, 2016

(54) KNEE-REST FOR USE WITH INDIAN CLASSICAL VIOLIN

(71) Applicant: Shivram S. Iyer, Potomac, MD (US)

(72) Inventor: Shivram S. Iyer, Potomac, MD (US)

(73) Assignee: SSI TECHNOLOGIES, Potomac, MD (US)

( * ) Notice: Subject to any disclaimer, the term of this patent is extended or adjusted under 35 U.S.C. 154(b) by 0 days.

(21) Appl. No.: 14/635,428

(22) Filed: Mar. 2, 2015

(65) Prior Publication Data

US 2016/0118029 A1 Apr. 28, 2016

Related U.S. Application Data

(63) Continuation of application No. 14/521,981, filed on Oct. 23, 2014, now Pat. No. 8,969,690.

(51) Int. Cl.
*G10G 5/00* (2006.01)
*G10D 1/02* (2006.01)

(52) U.S. Cl.
CPC ... *G10G 5/00* (2013.01); *G10D 1/02* (2013.01)

(58) Field of Classification Search
CPC ..... G10D 3/18; G10D 3/00; G10G 5/00
USPC ..... 84/267, 280
See application file for complete search history.

(56) References Cited

U.S. PATENT DOCUMENTS 8,969,690 B1 * 3/2015 Iyer ..... 84/280

* cited by examiner

*Primary Examiner* — Kimberly Lockett
(74) *Attorney, Agent, or Firm* — Sughrue Mion, PLLC

(57) ABSTRACT

A violin knee-rest comprising a support with a connecting member attached. A rigid having an elongated opening member is attached to the connecting member. A sliding member is attached to a screw with a U shaped head and a screw thread. The sliding member is configured to slide across the rigid member through the first elongated opening. The sliding member having an elongated opening is configured to be fastened at a desired location on the sliding member by a first wing nut and a first washer arrangement. The violin receiving member has a first end which is threaded. The violin receiving member has a second end which is concave shaped to hold a base of the violin. The receiving member is configured to slide across the second elongated opening of the sliding member. The violin receiving member is configured to be fastened at a desired location on the sliding member.

11 Claims, 8 Drawing Sheets

KNEE-REST FOR USE WITH INDIAN CLASSICAL VIOLIN

This is a continuation of U.S. application Ser. No. 14/521,981, filed on Oct. 23, 2014, the disclosure of which is incorporated herein in its entirety by reference.

BACKGROUND

1. Field

A. The disclosed teachings relate to a leg knee-rest used for anchoring a violin that is used for playing in the Indian classical music style.

2. Description of the Related Art

Two types of classical music styles are in vogue in India. They are named Hindustani and Carnatic styles of music. In both styles of music, violin is played both as a lead instrument in a chamber music style or as an accompanying instrument. A typical vocal chamber music concert includes a lead singer and possibly one or two accompanying singers squatting cross-legged on the floor. One or two accompanying violinists also sit on the floor next to the vocalists. One or two percussionists also sit on the floor on the other side of the vocalist. In some chamber music concerts, there may be a lead instrumentalist replacing the lead vocalist. In some cases, the violinist himself/herself would be the lead instrumentalist. However, in most cases in the Carnatic style of music a violinist accompanies the lead singer.

As noted above, all the singers sit on the floor. Therefore, the violinist is required to sit on the floor. In western violin, the violinist holds the bow in one hand. Using the other hand, the violinist holds down the string on the fingerboard at an appropriate location depending on the desired frequency. The same hand that is used to hold down the string is also used to hold the violin. In other words, the non-bow hand serves the dual purpose of holding the violin as well as holding down the string onto the fingerboard.

However, a violinist plays the Indian violin while sitting down cross legged on the floor. FIG. 1 shows a violinist sitting cross-legged on the floor in the traditional style. For a right-handed person, the right leg is extended forward a bit and the violin is anchored between the left chin and the concave inner portion of the heel as shown in FIG. 1. As can be seen, in the Indian classical style of playing violin, the stringing hand or the non-bow hand is used only to hold down the string onto the fingerboard to generate the right note. This hand is not used to hold the weight of the violin. Also, by having the ability to move the feet and the chin in unison, the violinist develops a feel for positioning the violin to give the maximum effect to his/her unique style of playing. Also, the Indian violinist enjoys a greater flexibility in the use of the stringing or non-bow hand because it is not required to hold the weight of the violin.

It is clear that for playing in the Indian style of music sitting cross-legged is necessary. This poses a problem for people who for some medical reason cannot sit cross legged on the floor. Such a condition is very often seen as people grow older and have a knee problem. In some cases, because of a replacement knee, it may not be possible to bend the knee for sitting cross-legged on the floor. After becoming comfortable with anchoring the violin in a specific way according to the traditional Indian style of sitting cross-legged on the floor, they will find it difficult to play violin sitting on a chair and being forced to hold the violin with the stringing or non-bow hand. This does not give the same feel as what they are used to and will affect the way in which they play the violin. They will feel the need to relearn playing the violin while holding the weight of the violin. For a professional musician, this could lead to a severe undermining of their career if they are unable to deliver the same quality of music as they were used to delivering because of the need to hold the weight of the violin. Furthermore, they may also need to develop additional strength to hold the weight of the violin for periods extending in some cases to three hours as the typical concerts could be that long.

The disclosed teachings are aimed at overcoming these disadvantage and providing a technique for playing the violin Indian style while seated on a chair and without the need to hold up the violin using the non-bow or stringing hand.

SUMMARY

To overcome some of the disadvantages and realize the advantages, there is provided a violin knee-rest for use with an Indian classical violin, the violin knee-rest comprising a support configured to be secured around a thigh of a violinist above a knee. A connecting member is attached to the first support. A rigid member is attached to the connecting member. The rigid member has a first elongated opening extending substantially across a length of the rigid member, the rigid member being substantially transverse to the thigh of the violinist when the support is attached to the thigh of the violinist. A sliding member is attached to a screw with a U shaped head and a screw thread. The sliding member is configured to slide across the rigid member through the first elongated opening. The sliding member is configured to be fastened at a desired location on the sliding member by a first wing nut and a first washer arrangement. The sliding member has a second elongated opening extending substantially across a length of the sliding member. The violin receiving member has a first end which is threaded. The violin receiving member has a second end which is concave shaped to hold a base of the violin. The receiving member is configured to slide across the second elongated opening of the sliding member. The violin receiving member is configured to be fastened at a desired location on the sliding member using a second wing nut and second washer arrangement. The concave shaped second end has a cushion interior to rest the violin, the cushion being shaped to hold an end of the violin.

In a specific enhancement, wherein the rigid member is made of plastic.

In another specific enhancement, the sliding member is made of plastic.

In another specific enhancement, the rigid slider has smooth edges.

In yet another specific enhancement the sliding member has smooth edges.

In still another specific enhancement, the connecting member is integrated with the support.

In still another enhancement the sliding member is integrated with the U shaped head.

In still another specific enhancement, the receiving member is made of plastic.

In still another enhancement, the cushion is made of velvet material.

In still another enhancement, the support is made of flexible plastic with smooth surface configured to being slid onto the thigh of the violinist.

In still another enhancement, the support comprises a belt configure to be fastened around the thigh.

In still another enhancement, the support comprises a velcro arrangement configure to be fastened around the thigh.

In still another enhancement, a height at which the receiving member is position is configured to be changed using spacers.

Another aspect of the disclosed teachings is a method of holding and resting a violin for use in Indian classical music, the method comprising sliding a flexible support having a rigid member attached to the flexible support onto a thigh of the violinist at a first appropriate spot slightly above a knee. A sliding member is slid across a first elongated opening on the rigid member to a second appropriate spot on the rigid member. The sliding member is fastened onto the rigid member at the second appropriate spot. A violin receiving member is slid across a second elongated opening on the sliding member to a third appropriate spot in the sliding member. The violin receiving member is fastened at the third appropriate spot. The violin is anchored on a concave pouch at an end of the violin receiving member.

BRIEF DESCRIPTION OF THE DRAWINGS

The above and/or other aspects of the present invention will be more apparent by describing in detail exemplary embodiments thereof, with reference to the accompanying drawings in which.

DETAILED DESCRIPTION

Certain exemplary embodiments are described in greater detail with reference to the accompanying drawings.

Figure 1:
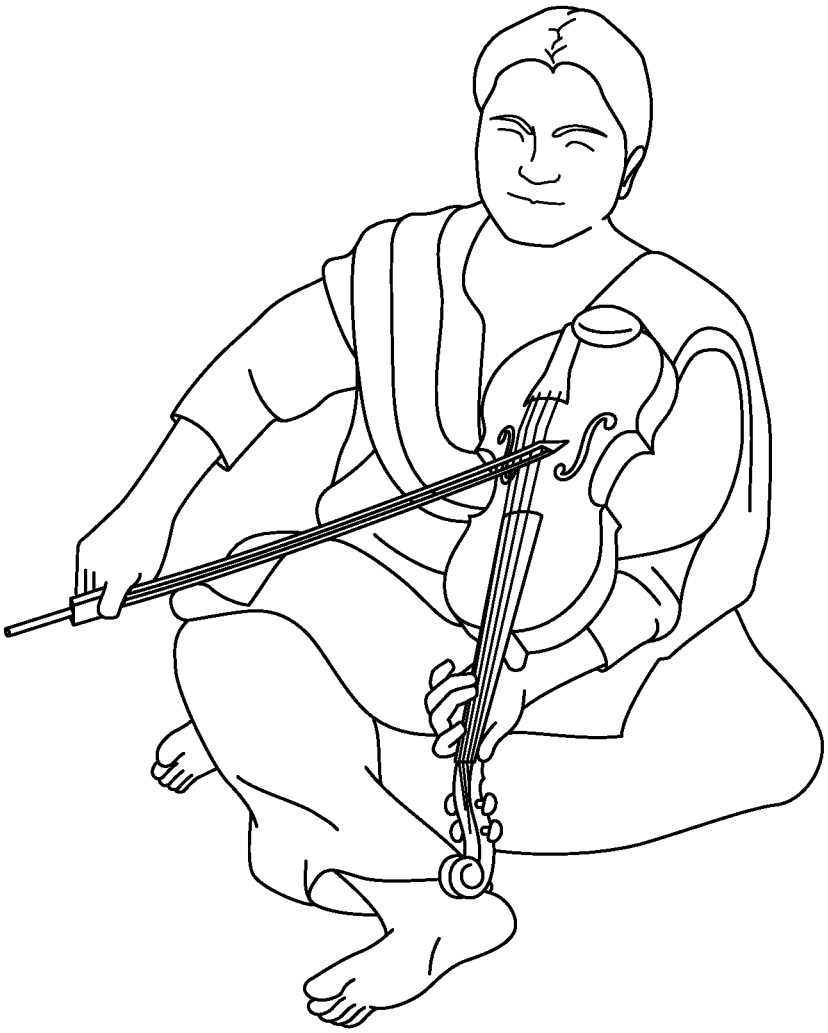
FIG. 1 shows an Indian classical violinist in the traditional posture sitting cross-legged on the ground.
Figure 2:
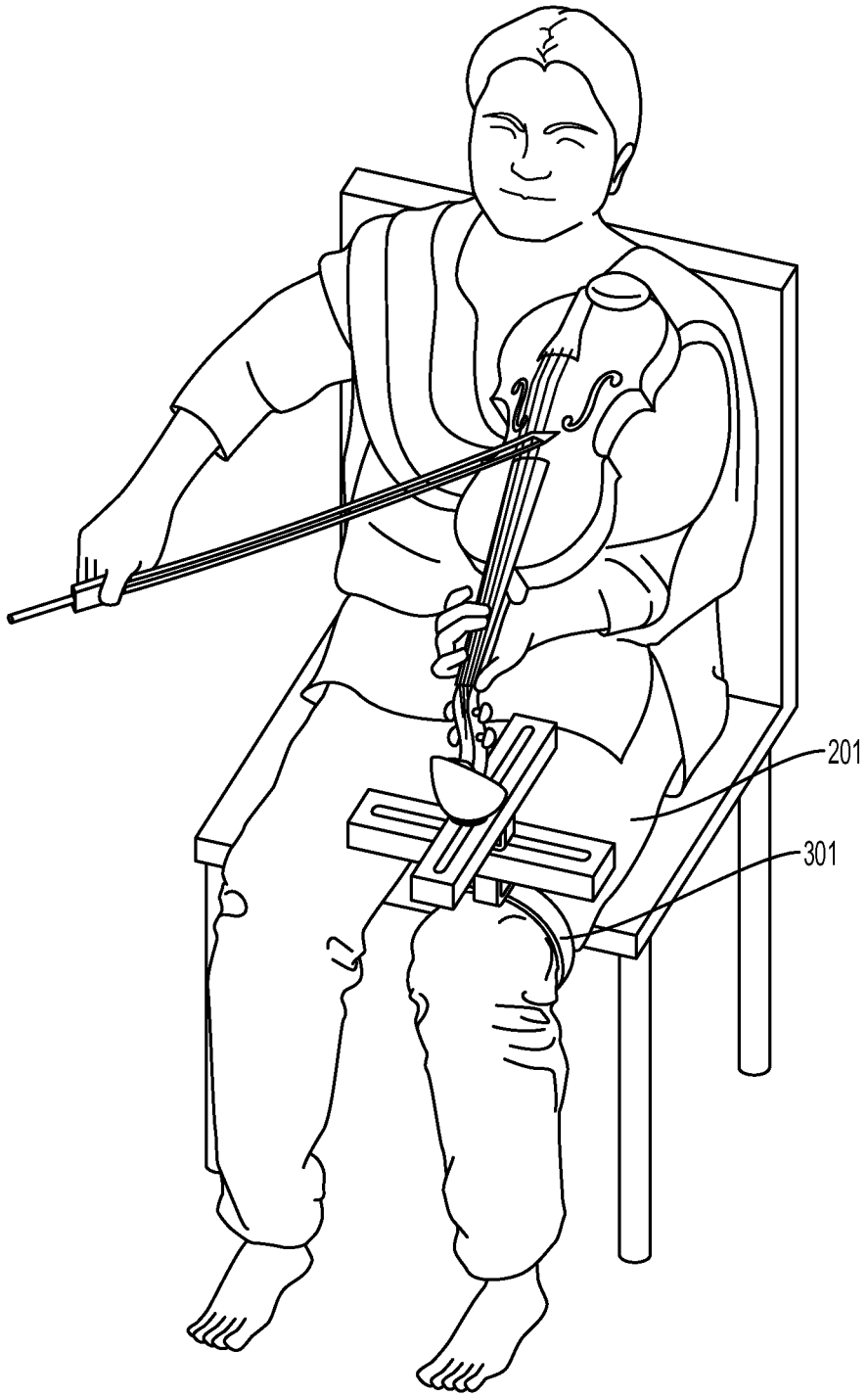
FIG. 2 shows the Indian classical violinist seated on a chair using an embodiment of the disclosed violin knee-rest for anchoring the violin while sitting on a chair.
Figure 3:
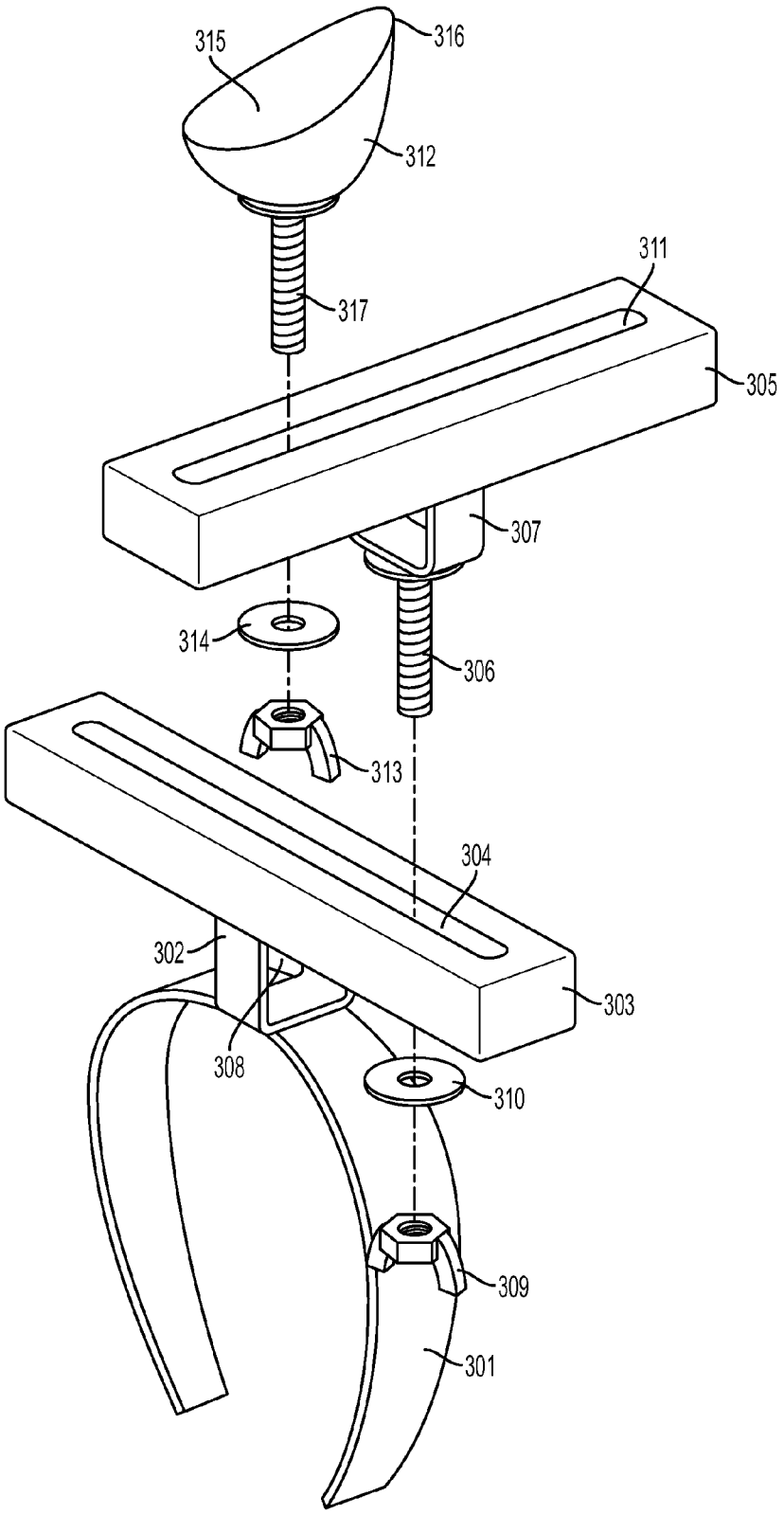
FIG. 3 shows various parts and components of an embodiment of the disclosed violin knee-rest.

FIG. 3 shows an exemplary embodiment of the disclosed teachings. A violin knee-rest for use with an Indian classical violin is shown with the parts disassembled for purposes of illustration. A support 301 is provided. The support 301 is configured to be secured around a thigh of a violinist above a knee. FIG. 2 shows a violinist where the support 301 is shown to be secure around the thigh 201 of the violinist. In this embodiment, the support is made of a material that is firm but flexible. It can be expanded to insert above the thigh but it secures reasonable tightly around the thigh. It is contemplated that the material used and the flexural or bending strength should not be too high that it is painful to wear and causes stoppage of the blood flow in the thigh.

A connecting member 302 is attached to the support 301. A rigid member 303 is attached to the connecting member 302. The rigid member has a first elongated opening 304 extending substantially across the length of the rigid member. The first elongated opening 304 can be long enough to provide the maximum range of motion for the sliding member described in greater detail below. However, the structural integrity of the rigid member 303 should not be compromised by having too large an opening. The rigid member 303 is substantially transverse to the thigh 201 of the violinist when the support is attached to the thigh 201 of the violinist as shown in FIG. 2.

A sliding member 305 is attached to a screw with a U-shaped head 307 and a screw thread 306. The sliding member 305 is configured to slide across the rigid member 303 through the first elongated opening 304, The sliding member is configured to be fastened at a desired location on the rigid member 303 by a first wing nut 309 and a first washer 310 arrangement.

The connecting member 302 is U shaped such that the space 308 in between the U-shape will enable the screw 306 attached to the sliding member 305 (described in detail later on) to easily be fastened at any position in the elongated opening 304 without facing any obstruction.

The sliding member 305 has a second elongated opening 311 extending substantially across the length of the sliding member 305. The second elongated opening 311 can be long enough to provide the maximum range of motion for the violin receiving member 312 described in greater detail below. However, the structural integrity of the sliding member 305 should not be compromised by having too large an opening.

A violin receiving member 312 is provided to hold a base of the violin. The violin receiving member has a first end 317 which is threaded. The violin receiving member 312 has a second end 316 which is concave shaped to hold a base of the violin. The violin receiving member 312 is configured to slide across the second elongated opening 311 of the sliding member 305. The violin receiving member 312 is configured to be fastened at a desired location on the sliding member using a second wing nut 313 and second washer arrangement 314 and the screw threads at the first end 317 of the violin receiving member 312.

The concave shaped second end 316 of the violin receiving member has cushion interior 315 to rest the violin, the cushion being shaped to hold an end of the violin as shown in FIG. 2. The cushion can be made of velvet or other suitable material that can provide cushioning. This is intended to lessen the impact of the violin with any rigid surface. The inventor believes that the tonal quality of the sound will be affected if the violin is anchored to a rigid surface.

Figure 4:
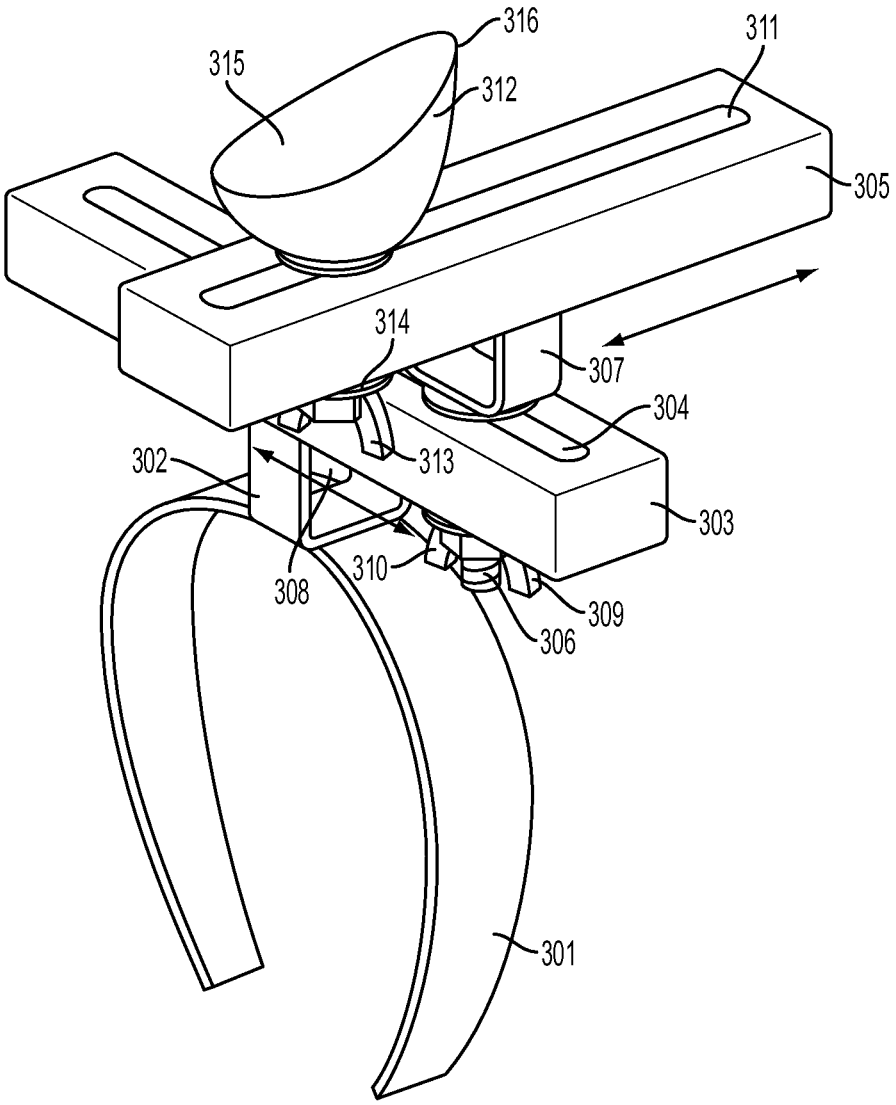
FIG. 4 shows the embodiment of violin knee-rest in an assembled form.
Figure 5:
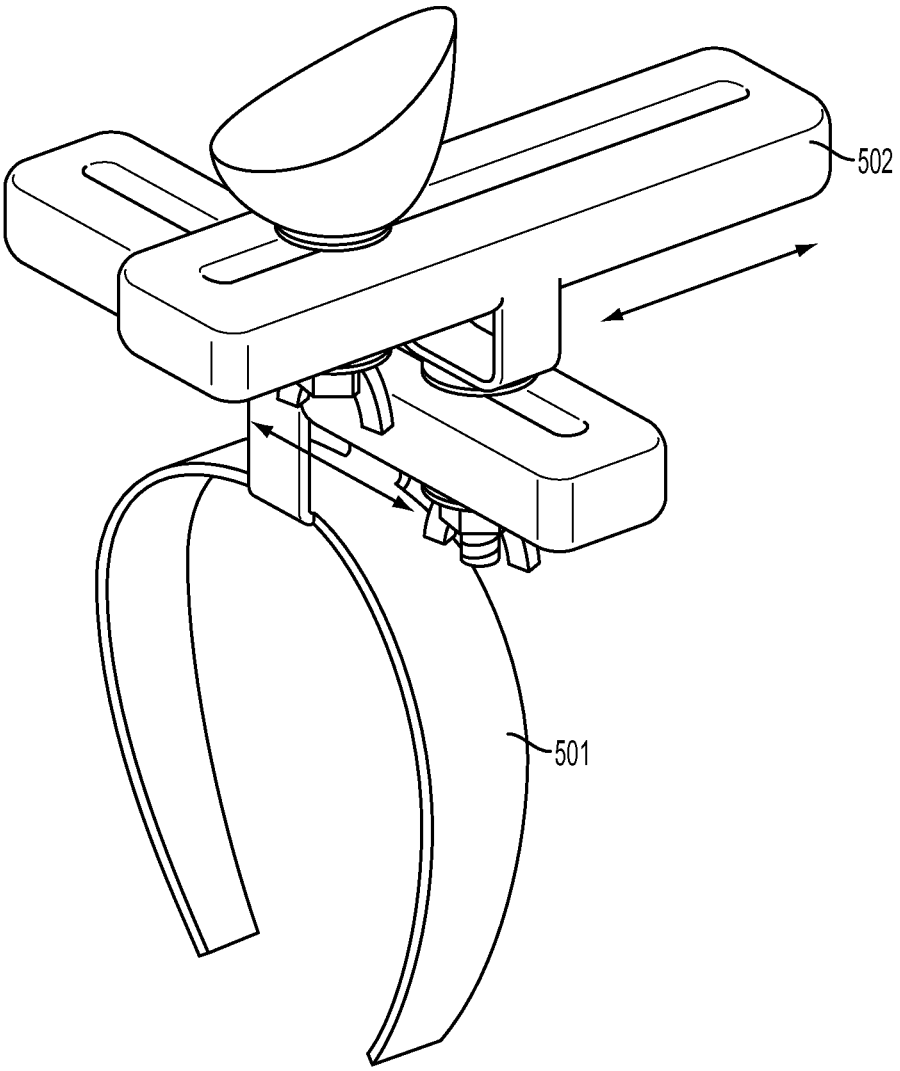
FIG. 5 shows an assembled version of another embodiment of the violin knee-rest where the edges are smooth.

FIG. 4 shows the embodiment described above with all the parts assembled. As can be seen, the assembled structure is simple but provides sufficient and comfortable positioning for the base of the violin without unduly affecting the tonal quality or the of the violinist. FIG. 4 also shows the direction and range of motion provided by the violin knee-rest. As can be seen in conjunction with FIG. 2, a violinist is provide with immense flexibility in While the embodiment shown in FIG. 3 is simple and can be made by a carpenter in a workshop using wood and simple commonly found and affordable materials, the surfaces could be rough. FIG. 5 shows an assembled version of another embodiment of the violin knee-rest where the edges are smooth. Since it is contemplated that the knee rest is used in close contact to the body, there is an advantage to avoiding rough surfaces. In the embodiment shown in FIG. 5, most of the parts are made of plastic with smooth surfaces. Since the structure is made of plastic, parts can be integrated with each other and molded together.

In the embodiment shown in FIG. 5, the support 301 and the connecting member 302 and the rigid member 303 of FIG. 3 are integrated in into a single support structure 501. Otherwise, these parts function in the same fashion as in the embodiment of FIG. 3. Likewise, the sliding member 305, the screw with a U-shaped head 307 and a screw thread 306 are integrated together into a sliding structure 502. Both 501 and 502 have smooth surfaces and are made of molded plastic in the embodiment of FIG. 5.

Figure 6:
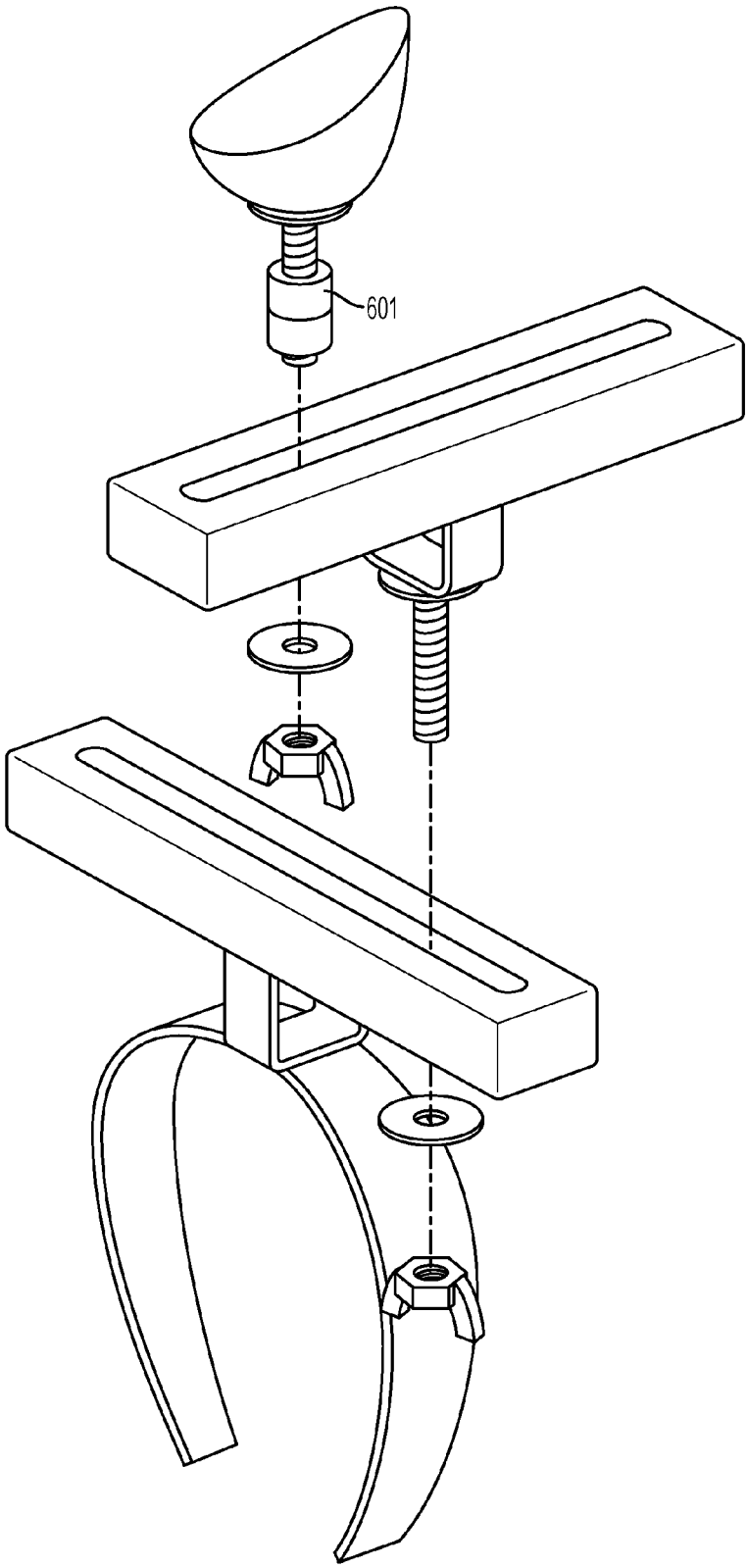
FIG. 6 shows an embodiment of the violin knee-rest with spacers to adjust the height of the violin receiving member.

As can be seen, because of the range of motions provided by the sliding member 305 and the violin receiving end 312 in the directions transverse and parallel to the thigh of the violinist, the violin receiving member 312 can be positioned at a wide range of locations. In addition to these positions, it will be advantageous to be able to adjust the height at which the violin receiving member is positioned. In the embodiment shown on FIG. 6, one or more spacers 601 can be added to the thread at the first end 317 of the violin receiving member.

Figure 7:
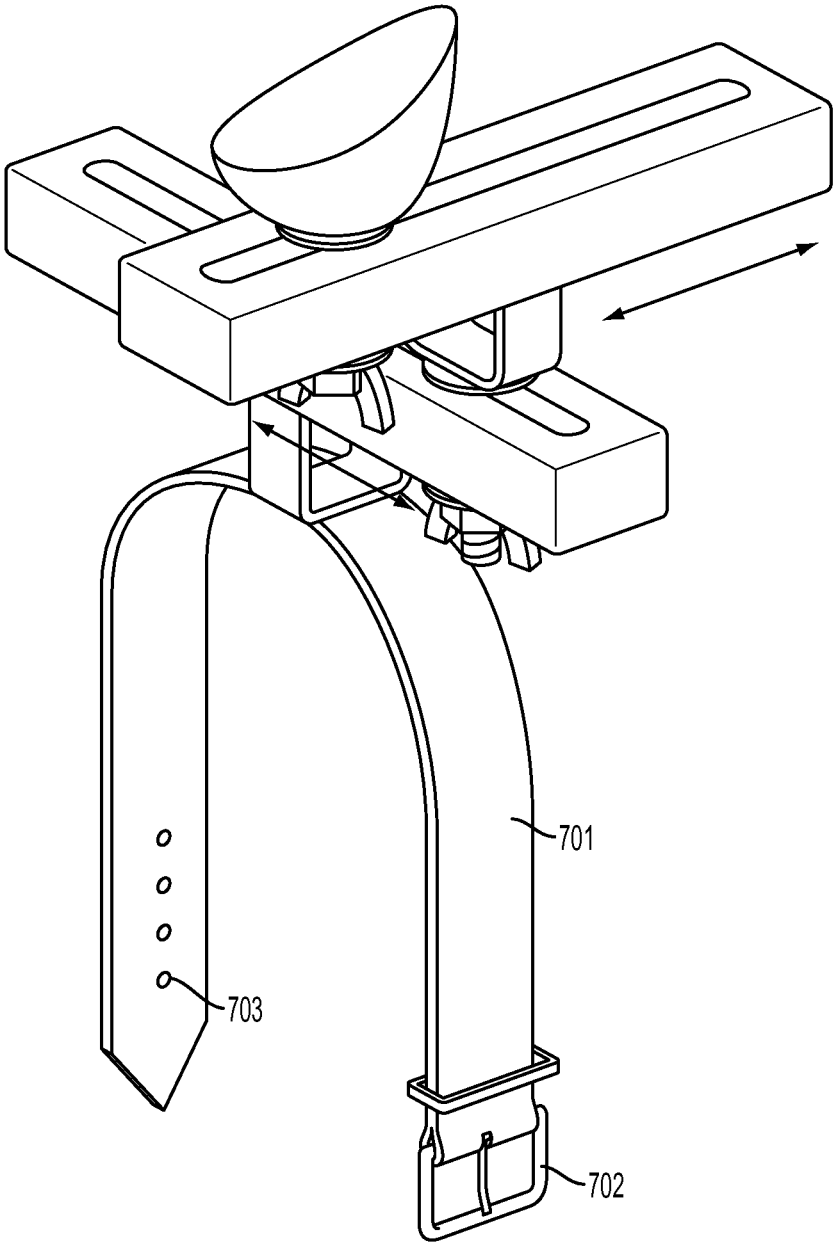
FIG. 7 shows an embodiment of the violin knee-rest where the support is a belt configured to be fastened around the thigh.

While in the embodiment of FIG. 3, the support is a rigid but flexible material with a good flexural or bending strength, in the embodiment shown in FIG. 7, a belt arrangement 701 is shown which can be used. The violinist would strap the support the belt arrangement using the buckle 702 and the appropriate hole 703.

Figure 8:
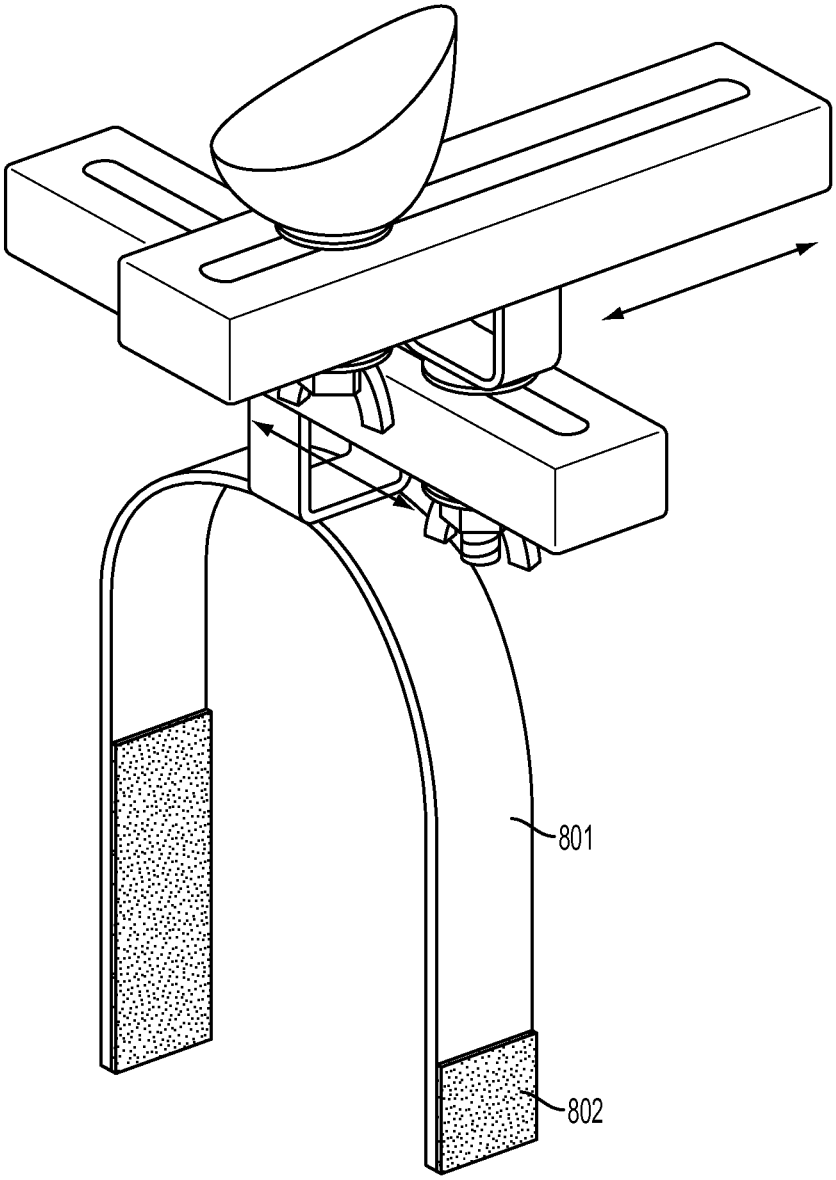
FIG. 8 shows an embodiment of the violin knee rest where the support is a velcro arrangement configured to be fastened around the thigh.

In the embodiment of FIG. 8 a strap 801 with velcro 802 is used to fasten the violin knee-rest onto the thigh of the violinist.

In operation, a violinist would first be seated a on the chair and get a feel of the position and location on the thigh that the violinist would like the knee rest to be positioned. The violinist would then fasten the support 301 onto the position in the thigh. The violinist would then slide the sliding member 305 across the first elongated opening 304 and find an appropriate spot to fasten the sliding member 305 onto the rigid member 303. The violinist would then fasten the sliding member 305 onto the rigid member at the appropriate spot using the screw 306, the first wing nut 309 and the first washer 310. The violinist will then slide the violin receiving member 312 across the second elongated opening 311 on the sliding member 305 to determine a second appropriate spot. The violinist will then fasten the violin receiving member 312 at the second appropriate spot using the thread at the first end 317 of the violin receiving member, the second wing nut 313 and the second washer 314. After that the violinist will anchor the end of the violin on the cushion 315 at the second concave end 316 of the violin receiving member 312.

Although a few embodiments have been shown and described, it would be appreciated by those skilled in the art that changes may be made in this embodiment without departing from the principles and spirit of the invention, the scope of which is defined in the claims and their equivalents.

What is claimed is:

1. A violin knee-rest for use with an Indian classical violin, the violin knee-rest comprising:

a support configured to be secured around a thigh of a violinist above a knee;

a rigid member having a first elongated opening extending substantially across a length of the rigid member operably connected to the support, the rigid member being substantially transverse to the thigh of the violinist when the support is attached to the thigh of the violinist;

a sliding member operably attached to the rigid member, the sliding member configured to slide across the rigid member through the first elongated opening, the sliding member configured to be fastened at a desired location on the rigid member;

the sliding member having a second elongated opening extending substantially across a length of the sliding member; and a violin receiving member having a first end and a second end which is concave shaped to hold a base of the violin;

the violin receiving member configured to be fastened at a desired location on the sliding member.

2. The violin knee-rest of claim 1, wherein the rigid member is made of plastic.

3. The violin knee-rest of claim 1, wherein the sliding is made of plastic.

4. The violin knee-rest of claim 1, wherein the rigid member has smooth edges.

5. The violin knee-rest of claim 1, wherein the sliding member has smooth edges.

6. The violin knee-rest of claim 1, where the violin receiving member is made of plastic.

7. The violin knee-rest of claim 1 wherein the support is made of a flexible plastic with smooth surface and configured to being slid onto the thigh and clamp tightly on the thigh.

8. The violin knee-rest of claim 1, wherein the support comprises a belt configured to be fastened around the thigh.

9. The violin knee-rest of claim 1, wherein the support comprises a velcro arrangement configure to be fastened around the thigh.

10. The violin knee-rest of claim 1, wherein a height at which the receiving member is position is configured to be changed using spacers.

11. A method of holding and resting a violin for use in Indian classical music, the method comprising:

sliding a flexible support having a rigid member attached to the flexible support onto a thigh of the violinist at an appropriate spot slightly above a knee;

fastening the sliding member onto the rigid member at an appropriate spot;

fastening a receiving member at a second appropriate spot on the sliding member;

anchoring the violin on a concave pouch at an end of the receiving member.

* * * * *